US005655449A

United States Patent [19]

Henn et al.

[11] Patent Number: 5,655,449

[45] Date of Patent: Aug. 12, 1997

[54] SHEET-GUIDING SYSTEM

[75] Inventors: Manfred Henn, Heidelberg; Josef Wehle, Schwetzingen, both of Germany

[73] Assignee: Heidelberger Druckmaschinen AG, Heidelberg, Germany

[21] Appl. No.: 522,863

[22] Filed: Sep. 1, 1995

[30] Foreign Application Priority Data

Sep. 2, 1994 [DE] Germany ..... 44 31 255.5
Jul. 6, 1995 [DE] Germany ..... 195 24 641.1

[51] Int. Cl.[6] ..... B41F 23/04

[52] U.S. Cl. ..... 101/232; 101/424.1

[58] Field of Search ..... 101/232, 419, 101/420, 424.1; 271/195; 34/122, 114

[56] References Cited

U.S. PATENT DOCUMENTS

| | | | |
|---|---|---|---|
| 2,138,178 | 11/1938 | Lang | 101/217 |
| 3,231,165 | 1/1966 | Wallin et al. | 226/97 |
| 3,622,058 | 11/1971 | Vits | 101/424.1 |
| 4,429,864 | 2/1984 | Scarpa et al. | 271/10 |
| 4,719,708 | 1/1988 | Karlsson et al. | 34/155 |
| 4,852,492 | 8/1989 | Pfizenmaier | 101/424.1 |
| 5,062,217 | 11/1991 | Tolson | 34/22 |
| 5,174,047 | 12/1992 | Gross | 34/114 |
| 5,471,766 | 12/1995 | Heikkila et al. | 34/461 |
| 5,497,987 | 3/1996 | Henn et al. | 101/232 |

FOREIGN PATENT DOCUMENTS

| | | | |
|---|---|---|---|
| 0 183 928 | 6/1986 | European Pat. Off. . | |
| 583 479 | 9/1933 | Germany . | |
| 665 310 | 9/1938 | Germany . | |
| 741 480 | 11/1943 | Germany . | |
| 937 106 | 12/1955 | Germany . | |
| 1 449 656 | 6/1972 | Germany . | |
| 23 37 385 | 2/1975 | Germany . | |
| 3713344 | 2/1988 | Germany | 271/204 |
| 34 43 704 | 7/1988 | Germany . | |
| 3-7149 | 1/1991 | Japan . | |
| 2 273 489 | 6/1994 | United Kingdom . | |

*Primary Examiner*—Edgar S. Burr
*Assistant Examiner*—Daniel J. Colilla
*Attorney, Agent, or Firm*—Herbert L. Lerner; Laurence A. Greenberg

[57] ABSTRACT

A gripper device of a sheet-guiding system grips a leading edge of a sheet freshly printed on at least one side thereof. The sheet is guided along an imaginary guide path in a sheet travel direction extending perpendicularly to the leading edge of the sheet. A plurality of first air blast nozzles having respective nozzle openings emit an air flow onto a surface of the sheet. The air flow has a first main flow direction extending in parallel with and in the direction of sheet travel. A plurality of second blast nozzles emit respective air jet bundles in a respective second main flow direction perpendicular to the leading edge of the respective sheet. The first and the second main flow directions, respectively, intersect at a common starting point and define an angle therebetween having a maximum value of 90° and, in a condition wherein the second main flow direction of the air jet bundles is inclined with respect to the guide path, an imaginary elongation of a central air jet of the air jet bundles, respectively, passing through the guide path and impacting with the first nozzle openings.

6 Claims, 1 Drawing Sheet

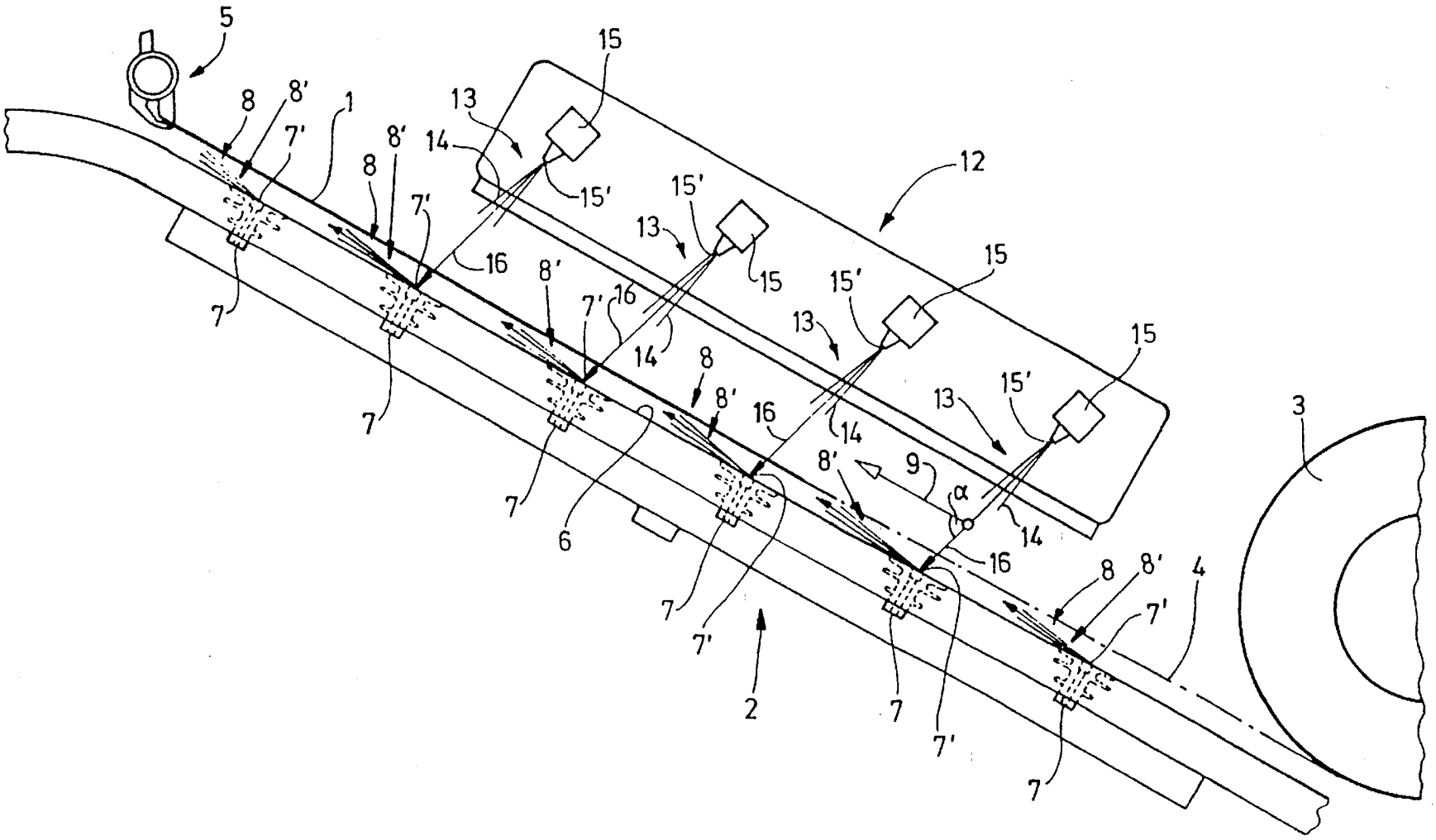
3
4
8'
7'
8
7
15
15'
14
16
α
9
12
13
2
6
1
5

SHEET-GUIDING SYSTEM

BACKGROUND OF THE INVENTION

1. Field of the Invention

The invention relates to a sheet-guiding system including a transporting device carrying a gripper device for gripping a leading edge of a sheet freshly printed on at least one side thereof and guiding the sheet along an imaginary guide path in a sheet travel direction extending perpendicularly to the leading edge of the sheet, a member having a sheet guide surface spaced from the guide path, and a plurality of air blast nozzles disposed in the member and having respective nozzle openings disposed in the sheet guide surface for emitting an air flow onto a sheet surface facing towards the sheet guide surface.

2. Description of Related Art Including Information Disclosed Under 37 CFR 1.97–1.99

A guiding system of the foregoing general type has become known heretofore, for example, from the Japanese Patent JP 3-7149 U. Disclosed therein is a chain delivery of a sheet-fed rotary printing press wherein a leading edge of a printed sheet is temporarily clamped in a gripper device which is linked to a respective endless chains of a pair thereof revolving in parallel paths, so that the leading edge of the sheet brushes against or grazes an imaginary guide surface in a sheet transport direction extending perpendicularly to the leading edge of the sheet. At a respective distance from locations on the guide surface, a sheet guide surface in the form of a surface of a guide plate is provided. A respective sheet, traveling on a path thereof defined by the gripper device, is subjected to an air flow between the sheet and the sheet guide surface. This air flow is produced by individual jets of air emerging from the sheet guide surface. Guidance of a freshly printed sheet in a delivery of a sheet-fed printing press is thereby assisted or aided by the air flow, in order to achieve a sheet transport which is as steady or undisturbed as possible. In spite of this provision, however, smearing of the yet wet ink, particularly in a first-form and perfector or recto/verso printing operation, cannot be avoided entirely with this heretofore known guiding system. A reason therefor particularly is the whip-like movements of the non-forcibly guided trailing edge of the sheet.

SUMMARY OF THE INVENTION

It is accordingly an object of the invention to provide a sheet-guiding system of the aforementioned general type, which permits sheet transport to be smear-free.

With the foregoing and other objects in view, there is provided, in accordance with the invention, a sheet-guiding system including a transporting device carrying a gripper device for gripping a leading edge of a sheet freshly printed on at least one side thereof for guiding the sheet along an imaginary guide path in a sheet travel direction extending perpendicularly to the leading edge of the sheet, and a member having a sheet guide surface spaced from the guide path, comprising a plurality of first air blast nozzles disposed in the member and having respective nozzle openings disposed in the sheet guide surface for emitting an air flow onto a surface of the sheet facing towards the sheet guide surface, the air flow having a first main flow direction extending in parallel with and in the direction of sheet travel, means defining a second sheet surface facing away from the sheet guide surface, a plurality of second blast nozzles formed with respective nozzle openings for emitting respective air jet bundles having a respective second main flow direction and disposed in a plane perpendicular to the leading edge of the respective sheet, the first and the second main flow directions, respectively, intersecting at a common starting point and defining an angle therebetween having a maximum value of 90° and, in a condition wherein the second main flow direction of the air jet bundles is inclined with respect to the guide path, an imaginary elongation of a central air jet of the air jet bundles, respectively, passing through the guide path and impacting with the first nozzle openings, respectively, disposed in the sheet guide surface.

In accordance with another feature of the invention, at least the second air blast nozzles are constructed so as to be adjustable with respect to the direction in which they emit the respective air jet bundles thereof.

In accordance with a further feature of the invention, at least the first air blast nozzles are constructed so as to be adjustable with respect to the direction in which they emit the air flow thereof.

In accordance with an added feature of the invention, the second air blast nozzles are adjustable so that the angle defined by the first and the second main flow directions are adjustable to values between 90° and approximately 20°.

In accordance with an additional feature of the invention, at least the air jet bundles are formed by hot air.

In accordance with a concomitant feature of the invention, at least the air flows are formed by hot air.

The air flow has a main flow direction describable by means of a first directional arrow extending parallel to and in the sheet transport direction, and a second sheet surface facing away from the sheet guide surface is subjected to a plurality of bundles of air jets, each of the air jet bundles emerging from a respective second nozzle opening of a second air blast nozzle having a main flow direction describable by means of a second directional arrow located on a plane which is perpendicular to a leading edge of the respective sheet, the first and the second directional arrows, beginning from a common starting point at which the two directional arrows intersect, defining an angle having a maximum value of 90°, an imaginary elongation of a central air jet of a respective air jet bundle, in a condition wherein the main flow direction of the air jet bundle is inclined with respect to the guide path, being essentially directed to one of the first nozzle openings disposed in the sheet guide surface.

With the air flow of the first air blast nozzles being substantially directed in the sheet travel or transport direction, a layer of carrying air is formed on the underside of the sheet. Particularly when the respective central air jet of the air jet bundles impacting with the upper side of a sheet has an inclined orientation, the air jet bundles, together with the carrying air layer, form an air cushion arrangement enveloping a respective sheet and guiding it flutter-free as well as contact-free along the guide path. Accordingly, smear-free sheet travel or transport is assured, even for sheets freshly printed on both sides thereof. By orienting a respective central air jet perpendicularly to the guide path, on the other hand, a sufficiently smooth sheet travel or transport for one-side printing results.

In accordance with a further development of the invention, the first and/or the second air blast nozzles are constructed so as to be adjustable with regard to the blowing direction thereof. In a preferred embodiment of the invention, the second air blast nozzles are constructed so that the angle subtended by the first and the second directional arrows is adjustable to values between 90° and approximately 20°.

Finally, it is advantageous for the air jet bundles and/or the air flow on the underside of the sheet to be formed by hot air.

Other features which are considered as characteristic for the invention are set forth in the appended claims.

Although the invention is illustrated and described herein as embodied in a sheet-guiding system, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying single FIGURE of the drawing which is a diagrammatic side elevational view of a section of a delivery of a sheet-fed printing press incorporating the sheet-guiding system according to the invention.

DESCRIPTION OF THE PREFERRED EMBODIMENTS

Referring now to the FIGURE of the drawing, there is shown therein a section of a delivery of an otherwise non-illustrated sheet-fed printing press which includes a guiding device 2 for guiding printed sheets 1 oncoming from a delivery drum 3, passing them along a guide path 4 of the delivery and feeding them to a non-illustrated pile table. Transport of the sheets 1 is effected by means of a gripper device 5 having grippers with which a leading edge of a respective sheet 1 is gripped. The gripper device 5 is arranged on revolving guided chain strands which form the guide path 4.

Spaced from and extending parallel to the guide path 4 is a sheet guide surface 6 having a plurality of first air blast nozzles 7 embedded therein, preferably so as to be flush with the sheet guide surface 6. The first air blast nozzles 7 are formed with respective first nozzle openings 7'. Blowing or blast air 8 emerges from the first air blast nozzles 7 in a manner that an air flow 8' is generated having a main flow direction which extends in the sheet travel or transport direction. The sheet travel or transport direction is represented by means of a first directional arrow 9 and corresponds with the course of the guide path 4. A respective first sheet surface of the sheets 1 gripped by the gripper device 5 faces towards the sheet guide surface 6 and is subjected to the blowing air 8.

The delivery has a drying facility 12 located opposite the sheet guide surface 6. This drying facility 12 is capable of emitting infrared and/or ultraviolet rays, by means of which suitably sensitized printing inks can be dried in the fastest way possible. It is essential that this drying facility 12 have a so-called air knife, i.e., from which an air flow 13 emerges which, with respect to the blowing air 8 previously mentioned hereinabove, constitutes a second load or application of air. This second load of air results from a plurality of air jet bundles 14 emerging from second nozzle openings 15' of second air blast nozzles 15. The second air blast nozzles 15, like the first air blast nozzles 7, are also distributed in the longitudinal and transverse directions of the delivery. The second air blast nozzles 15 belong to or are associated with the drying facility 12. Blowing or blast air drying is thereby realized, the effect thereof being increasable by the use of hot air for creating the air jet bundles 14. Air-blast drying is used for the physical drying of printing ink on the sheets 1, the herein-aforementioned IR and/or UV rays being available to aid in the drying, but not absolutely required. The air flow 8' at the underside of the sheet 1 may also be created by means of hot air. The drying effect occurring in addition to the function of the guidance of the sheet 1 is increased when the main flow direction of the air jet bundles 14 is oriented perpendicularly to the guide path.

A respective second directional arrow 16 representing the main flow direction of a respective air jet bundle 14 is disposed in a plane which is perpendicular to a leading edge of the sheet 1. Both directional arrows 9 and 16, beginning from a common starting point at which they intersect, define an angle alpha having a maximum value of 90°. Particularly the second blowing nozzles 15 may be oriented or adjusted in such a way that the angle alpha defined by the first and second directional arrows 9 and 16 will assume values between 90° and approximately 20°.

The illustrated FIGURE of an exemplary embodiment of the invention shows the air jet bundles 14 with a main flow direction which is inclined with respect to the guide path 4. The air jet bundles 14 are directed or oriented therein in a manner that an imaginary elongation of the central air jet 16 of a respective air jet bundle 14 impacts virtually with a respective one of the first nozzle openings 7'. When the inclination of the air jet bundles 14 is varied, they impact with other respective ones of the first nozzle openings 7'. In this regard, a change in the inclination of the air jet bundles 14 is achieved by a stepwise adjustment of the second blast or blowing nozzles 15.

We claim:

1. Sheet-guiding system including a transporting device carrying a gripper device for gripping a leading edge of a sheet freshly printed on at least one side thereof for guiding the sheet along an imaginary guide path in a sheet travel direction extending perpendicularly to the leading edge of the sheet, and a member having a sheet guide surface spaced from the guide path, comprising a plurality of first air blast nozzles disposed in the member and having respective nozzle openings disposed in the sheet guide surface for emitting an air flow onto a surface of the sheet facing towards the sheet guide surface, said air flow having a first main flow direction extending substantially parallel with and in the direction of sheet travel, means defining a second sheet surface facing away from the sheet guide surface, a plurality of second blast nozzles formed with respective nozzle openings for emitting respective air jet bundles having a respective second main flow direction and being disposed in a plane perpendicular to the leading edge of the respective sheet, said first and said second main flow directions, respectively, intersecting and defining an angle therebetween having a maximum value of 90° and, in a condition wherein said second main flow direction of said air jet bundles is inclined with respect to the guide path, an imaginary elongation of a central air jet of said air jet bundles, respectively, passing through the guide path and onto the first nozzle openings, respectively, disposed in the sheet guide surface.

2. Guiding system according to claim 1, wherein at least said second air blast nozzles are constructed so as to be adjustable with respect to the direction in which they emit the respective air jet bundles thereof.

3. Guiding system according to claim 2, wherein said second air blast nozzles are adjustable so that said angle defined by said first and said second main flow directions are adjustable to values between 90° and approximately 20°.

4. Guiding system according to claim 1, wherein at least said first air blast nozzles are constructed so as to be adjustable with respect to the direction in which they emit said air flow thereof.

5. Guiding system according to claim 1, wherein at least said air jet bundles are formed by hot air.

6. Guiding system according to claim 1, wherein at least said air flows are formed by hot air.

* * * * *